US008262442B2

(12) United States Patent
Hein et al.

(10) Patent No.: US 8,262,442 B2
(45) Date of Patent: Sep. 11, 2012

(54) METHOD AND SYSTEM FOR MANAGING THERMAL ENERGY IN A BUILDING WITH DUCT FOR LIFTING INSTALLATIONS

(75) Inventors: Carlo Hein, Mertert (LU); Mike Hein, Born (LU)

(73) Assignee: Royal AFC S.A., Luxembourg (LU)

( * ) Notice: Subject to any disclaimer, the term of this patent is extended or adjusted under 35 U.S.C. 154(b) by 943 days.

(21) Appl. No.: 11/956,050

(22) Filed: Dec. 13, 2007

(65) Prior Publication Data

US 2008/0146135 A1 Jun. 19, 2008

Related U.S. Application Data

(63) Continuation of application No. PCT/EP2006/062577, filed on May 24, 2006.

(30) Foreign Application Priority Data

Jun. 13, 2005 (LU) ..... 91 175

(51) Int. Cl.
*F24F 7/00* (2006.01)
*B66B 1/06* (2006.01)
*B66B 1/34* (2006.01)

(52) U.S. Cl. ..... 454/68; 187/289; 187/393

(58) Field of Classification Search ..... 454/68; 187/289, 393

See application file for complete search history.

(56) References Cited

U.S. PATENT DOCUMENTS

| | | | | |
|---|---|---|---|---|
| 5,718,627 | A | 2/1998 | Wicks | |
| 5,977,872 | A * | 11/1999 | Guertin | 340/515 |
| 6,269,911 | B1 * | 8/2001 | Richter | 187/289 |
| 2004/0098140 | A1 * | 5/2004 | Hess | 700/3 |

FOREIGN PATENT DOCUMENTS

| | | | |
|---|---|---|---|
| DE | 29906399 | | 9/1999 |
| DE | 19856193 | | 6/2000 |
| EP | 0695918 | | 2/1996 |
| EP | 0995955 | | 4/2000 |
| EP | 1050507 | | 11/2000 |
| GB | 1066483 | | 4/1967 |
| JP | 04209186 | A * | 7/1992 |
| JP | 07215603 | A * | 8/1995 |

OTHER PUBLICATIONS

Abstract english translation of JP 04209186 A.*
English translation of Abstract of JP 07215603 A.*
International Search Report; PCT/EP2006/062577; Sep. 26, 2006.

* cited by examiner

*Primary Examiner* — Steven B McAllister
*Assistant Examiner* — Helena Kosanovic
(74) *Attorney, Agent, or Firm* — Cantor Colburn LLP

(57) ABSTRACT

The invention concerns an energy management method in a building including a lifting installation with a mobile car in a shaft and a ventilation passage between the shaft and the atmosphere. The method includes the monitoring of at least one state parameter of the lifting installation; the evaluation, in a control unit, of the necessity to ventilate the shaft based on at least one state parameter;

the switching of an obturator element associated with the ventilation passage from an open position, wherein the ventilation passages is essentially open, to a closed position, wherein the ventilation passages is at least partially obturated, only when the evaluation indicates that ventilation of the shaft is not required, the obturator element being prestressed in its open position. The invention also concerns an energy management system designed to implement the method according to. The present method and system are particularly suitable for installation of a lift in a low-energy or passive building.

17 Claims, 1 Drawing Sheet

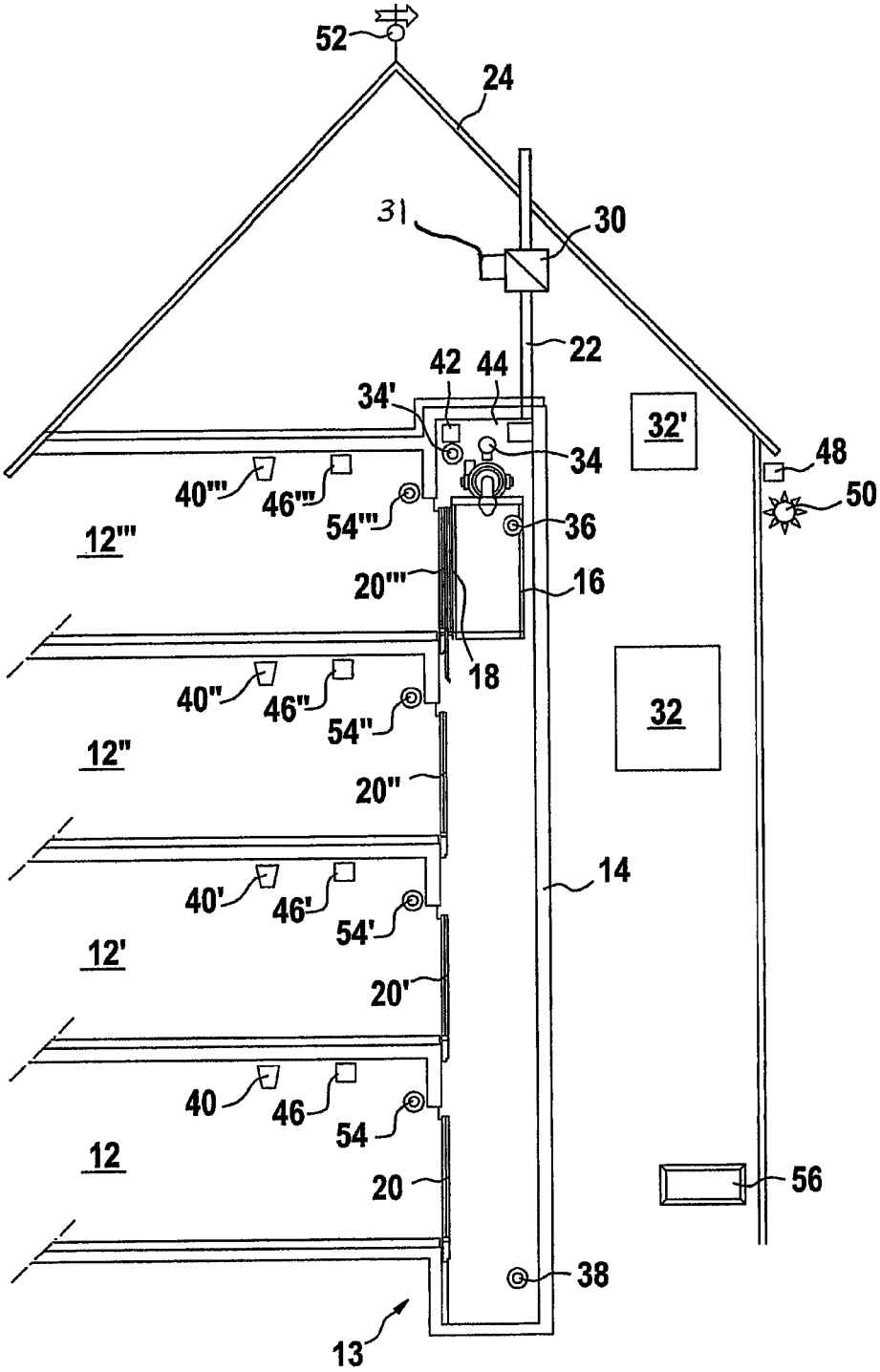
52
24
31
30
22
42
44
34'
34
32'
48
50
40'''
46'''
54'''
36
12'''
20'''
16
18
40''
46''
54''
32
12''
20''
14
40'
46'
54'
12'
20'
40
46
54
12
20
56
38
13

METHOD AND SYSTEM FOR MANAGING THERMAL ENERGY IN A BUILDING WITH DUCT FOR LIFTING INSTALLATIONS

CROSS REFERENCE TO RELATED APPLICATIONS

This application is a continuation under 35 U.S.C. 120 of International Patent Application Ser. No. PCT/EP2006/062577 filed on 24 May 2006, and claims the benefit under 35 U.S.C. 119 of Luxembourg Patent Application Serial No. LU 91 175 filed on 13 Jun. 2005, both of said applications are herein incorporated by reference in their entirety.

TECHNICAL FIELD OF THE INVENTION

The present invention concerns a thermal energy management, in particular energy-saving, method and system in a building comprising one or more shafts for lifting installations such as, for example, lifts, goods lifts or service lifts, in particular in a low-energy building.

BRIEF DESCRIPTION OF RELATED ART

Such a building usually comprises a shaft vertically crossing different levels of the building. For safety reasons, ventilation of the shaft is necessary, for example in the event of a person being trapped in a lift car or in the shaft. Ventilation of the shaft is also advantageous for avoiding excessive heating of the top part of the shaft, wherein technical equipment sensitive to temperature may be found. Furthermore, the shaft must comply with all the legal provisions in force.

Ventilation of the shaft is furthermore made compulsory by different legislations in force in a large number of countries. Thus, for example, it is compulsory for lift shafts to have proper ventilation in compliance with standards EN 81-1 and EN 81-2, transposed by directive CE/95/16 into national law in all member states of the European Community. In the absence of appropriate standards or regulations, it is recommended to provide ventilation orifices with a minimum area of 1% of the horizontal cross-sectional area of the shaft in the top part of the shaft. Furthermore, EN 81-1/EN81-2 prohibits use of the shaft for ventilation of rooms other than those specific to the lift. In many countries, governments require other lift shaft ventilation areas to guard against other very specific risks. In the Grand Duchy of Luxembourg, for example, a ventilation area of at least 2.50% of the horizontal cross-sectional area of the shaft is compulsory to additionally allow smoke extraction from the shaft in the event of fire.

There are several patents, which cover various specific situations involving ventilation forced by a fan in the event of fire or smoke in a building (U.S. Pat. No. 5,718,627, DE 198 56 193, EP 0 995 995, DE 299 06 399). Contrary to standard EN 81-1/EN 81-2 article 6.2.3 "Ventilation of the shaft", these systems use the lift shaft as a smoke extraction route for other rooms of the building. In these systems, the ventilation passage is kept closed, which is also contrary to the legal provisions of several countries. The ventilation passage is only open when a risk situation, such as a fire, is detected.

Apart from the legal provisions, there are also economic and ecological issues to be considered. Any ventilation of the shaft in fact leads to a source of major thermal losses. Heat loss through the shaft is inevitable, even in the case of simple natural ventilation of this shaft because the doors between the shaft and the different levels of the building can in fact not be airtight throughout the building. Such a heat loss should be prevented, particularly in low-energy buildings. The heat loss is usually so important that installation of a lift in low-energy or passive buildings is in fact made impossible.

One solution to preventing this heat loss is, for example, to dislodge the shaft outside the thermal envelope of the building. However, displacement of the shaft is often undesired or impossible. Another solution would be, for example, the construction of an airlock around the shaft and the accesses to the shaft. However, construction of such an airlock entails very high costs.

BRIEF SUMMARY OF THE INVENTION

The invention proposes a thermal energy management method and system in a building comprising a shaft for lifting installations, wherein the thermal loss is reduced, yet without having the disadvantages of the aforementioned solutions.

According to the invention, a thermal energy management, in particular energy-saving, method is provided. A building comprising a lifting installation comprises a mobile car in a shaft and a ventilation passage between the shaft and the atmosphere. According to the invention, the energy management method comprises the following steps:

the monitoring of at least one state parameter of the lifting installation; the monitoring of at least one state parameter comprising the monitoring of the presence of a person in the lifting installation and/or the monitoring of a movement of the car in the shaft;

the evaluation, in a control unit, of the necessity to ventilate the shaft based on said at least one state parameter, the control unit concluding to the necessity to ventilate the shaft when the presence of a person is detected and/or when the movement of the car is detected; and the switching of an obturator element associated with said ventilation passage from an open position, wherein the ventilation passage is essentially open, to a closed position, wherein the ventilation passage is at least partially obturated, only when the evaluation indicates that ventilation of the shaft is not required, the obturator element being prestressed in its open position.

This method allows to close the ventilation passage and, thereby, to prevent heat losses through the shaft and the ventilation passage. Under certain conditions, the method can therefore meet the requirements of energy-saving by preventing heat loss, whilst always remaining in compliance with legal, technical and safety requirements. Before switching the obturator element to the closed position, the method in fact checks whether the state of the lifting installation allows closing of the ventilation passage. During operation of the lifting installation, the shaft must be ventilated and the obturator element will therefore be kept in its open position. It is clear that the legal and technical requirements take precedence over the thermal energy management requirements and that the obturator element is only switched to a closed position when the legal and technical requirements allow this.

Furthermore, by preventing heat losses through the ventilation passage of a shaft, the method according to the invention allows installation of a lift in a low-energy or passive building.

The obturator element is only switched to a closed position in the presence of a positive instruction from the operating system and, as soon as this positive instruction is no longer present, the obturator element switches back to its open position. In the event of a power cut or failure of the system installed to implement the method, the ventilation passage thus is necessarily open.

The monitoring of at least one state parameter can comprise the monitoring of the presence of a person in the car, on the roof of the car or in the shaft. When the presence of a person is detected, the control unit deduces that the shaft must be ventilated. The presence of a person in the car indicates operation of the lifting installation, in which case legislation provides for the necessity to ventilate the shaft. The control unit ensures that the obturator element is kept in its open position. The presence of a person in a car, on the roof of a car or in the shaft can be detected by an independent system or else by the processing unit of the lifting installation itself.

The monitoring of at least one state parameter can comprise the monitoring of a movement of the car in the shaft. When a movement of the car is detected, the control unit deduces that the shaft must be ventilated. The movement of the car in fact indicates operation of the lifting installation, in which case legislation provides for the necessity to ventilate the shaft. This information can be supplied by an independent system or else by the operation of the lifting installation itself. The control unit ensures that the obturator element is kept in its open position.

The control unit can conclude that ventilation of the shaft is not necessary, when no presence of a person in the car, on the roof of the car or in the lift shaft is detected; no movement of the car is detected. In this case, it can be deduced that the lifting installation is not being operated. In this case, ventilation of the shaft is not dictated by legal or technical requirements. The obturator element is then free to be switched to its closed position to at least partially obturate the ventilation passage. This can lead to conservation of heat in the building, allowing, amongst other things, installation, until now impossible, of a lift in a low-energy or passive building.

According to a preferred embodiment, the energy-saving method can furthermore comprise the following steps:
the monitoring of at least one control parameter;
the evaluation of the usefulness of obturating the ventilation passage based on the at least one control parameter; and
the switching of the obturator element in its closed position when the control unit concludes the non-necessity to ventilate the shaft; and when the evaluation indicates that obturation of the ventilation passage is useful.

When no legal or technical requirement prohibits closure of the ventilation passage, the method allows evaluation of the usefulness to close the ventilation passage. The present method allows the obturator element to be switched to its closed position only when such closure is authorized and desired. When closure of the ventilation passage is authorized, thermal energy management of the building is possible by switching the obturator element between its open and closed positions. By closing the ventilation passage, heat losses of the building at the ventilation passage can be reduced, thereby leading to a saving of energy.

The monitoring of at least one control parameter preferably comprises monitoring at least one of the following parameters:
the temperature inside the building;
the temperature inside the shaft;
the presence of a person on a landing of a level of the building;
the temperature outside the building;
the wind speed outside the building; and
the level of solar radiation outside the building. It should be noted that this list is not exhaustive. Evaluation of these parameters can, even in the event of closure authorization in compliance with legal and technical requirements, lead to the decision to keep the ventilation passage open. This can be the case in summer, when the temperature in the building is much greater than the desired ambient temperature, and the outside temperature is less than the temperature inside the building.

Advantageously, the method further comprises the memorization in a storage unit of the state parameters, of the position of the obturator element and, if applicable, of the control parameters, thereby allowing verification of the proper operation of the system implementing the method. The memorized data can, for example after an incident, be used to prove that the lifting installation was in compliance with legislations.

The present invention also concerns a system installed to implement the above method. Such a thermal energy management system, in particular an energy-saving system, in a building comprising a lifting installation with a mobile car in a shaft and a ventilation passage between the shaft and the atmosphere further comprises:
an obturator element associated with the ventilation passage, the obturator element being mobile between an open position, wherein the ventilation passage is essentially open, and a closed position, wherein the ventilation passage is at least partially obturated; a prestressing means 31 for maintaining, in a passive state, the obturator element in its open position; and a control unit controlling the position of the obturator element, the control unit comprising means for monitoring at least one state parameter of the lifting installation and for evaluating the necessity to ventilate the shaft, the control unit only allowing switching of the obturator element to a closed position when the evaluation of the necessity to ventilate indicates that ventilation of the shaft is not required, the means for monitoring at least one state parameter of the lifting installation comprising at least one means for detecting the presence of a person in the lifting installation and/or at least one means for detecting movement of the car in the shaft, the control unit concluding the necessity to ventilate the shaft when the presence of a person is detected and/or when movement of the car is detected.

BRIEF DESCRIPTION OF THE FIGURE

Other particularities and characteristics of the invention will become apparent from the detailed description of an advantageous embodiment presented below with reference to the appended FIG. 1, which shows a diagrammatic cross-section through a building with a lift comprising a thermal energy management system according to the invention.

DETAILED DESCRIPTION OF THE INVENTION

A building 10 with several levels 12, 12', 12", 12''' is represented in FIG. 1. A lifting installation 13, in this case a lift installation, is vertically arranged in the building 10 to interlink the different levels 12, 12', 12", 12''' of the building 10. Such an installation comprises a shaft 14, wherein is mounted a car 16 connected to a motor (not represented), which makes the car 16 ascend and descend in the shaft 14.

The car 16 comprises a car door 18, which opens with a respective landing door 20, 20', 20", 20''' at the level 12, 12', 12", 12''', at which the car 16 stops to allow access between the car 16 and the respective level 12, 12', 12", 12'''.

A ventilation passage 22 connects the shaft 14 to the atmosphere through the roof 24 of the building 10. In compliance with European legislations in force, this ventilation passage 22 has a cross-sectional area corresponding to at least 1% of the cross-sectional area of the shaft 14.

Generally, the car doors 18 and landing doors 20, 20', 20", 20''' are not airtight and therefore allow an exchange of air between the shaft 14 and the different levels 12, 12', 12", 12'''. The ventilation passage 22, in its turn, allows an exchange of air between the shaft 14 and the atmosphere through the roof 24 of the building 10. With the exchange of air between the different levels 12, 12', 12", 12''' and the atmosphere, there is also an exchange of thermal energy, which, especially during cold periods, is reflected by extensive cooling of the shaft and thus a loss of heat in the building 10.

According to the present invention, an obturator element 30 such as, for example, a damper or valve is associated with the ventilation passage 22 and can switch between an open position and a closed position. In the open position, the obturator element 30 keeps the ventilation passage 22 open, thereby allowing the air to be exchanged between the shaft 14 and the atmosphere. In the closed position, the obturator element 30 at least partially obturates the ventilation passage 22, thereby allowing the heat to be kept inside the building 10 and thus preventing an unnecessary heat loss.

For safety reasons, the obturator element 30 is normally kept in an open position and is only switched to a closed position when conditions allow it. Thus, ventilation of the shaft 14 will be necessarily ensured in the event of a power cut, respectively in the event of a system failure. A control unit 32 is provided for evaluating the state parameters and for deciding on switching of the obturator element 30 to a closed position. A control unit 32 is designed to control the switching of the obturator element 30 in compliance with legislation, in other words to ensure that the shaft 14 is ventilated as stipulated by the law and the technical requirements.

For safety reasons and to comply with legislation, the obturator element 30 must, for example, be in an open position in the event of lift operation. A lift is considered to be operated if the car 16 is in movement or if a person is present in the shaft 14. Movements in the shaft 14 can be detected by the presence of a movement sensor 34 on the roof of the car 16 or of a movement sensor 34' at the top of the shaft, by a first presence sensor 36 in the car 16 or by a second presence sensor 38 in the pit of the shaft 14. When movement of the car 16 or presence of a person in the car or on the roof of the car is detected by the movement sensors 34 and 34' or the presence of a person is detected by the first or second presence sensor 36, 38, the control unit 32 deduces, from signals provided by these sensors 34, 34', 36, 38', that ventilation of the shaft 14 is necessary and consequently ensures that the obturator element 30 is in an open position.

A first temperature sensor 42 is furthermore installed in the top part 44 of the shaft 14. This first temperature sensor 42 detects the temperature in a zone, wherein there may be technical equipment sensitive to temperature. The first temperature sensor 42 is connected to the control unit 32 and provides it with a signal indicating the temperature detected. Based on the signal provided by the first temperature sensor 42, the control unit 32 can keep the obturator element 30 in an open position, in the event of excessive heating of the top part 44 of the shaft 14, to thereby protect the technical equipment installed in this zone. A second temperature sensor 48 can be used to distinguish between hot and cold periods. During hot periods, loss of heat may be non-existent or desired and the obturator element 30 can be controlled according to the ventilation and air-conditioning needs of the building. During cold periods, usually in winter, the obturator element 30 is preferably switched to its closed position to prevent loss of heat, which would otherwise be considerable. Installation of a lift has, to date, generally been accompanied by a loss of heat in winter, thereby for example making the installation of a lift in a low-energy or passive building impossible. Thanks to the method of the present invention, this loss of heat is however prevented and installation of a lift in such a low-energy or passive building is made possible.

When the car 16 is stationary and the car is not occupied by a person, and there is no person in the shaft 14, ventilation of the shaft 14 is not necessary because the installation is not used. In this situation, the obturator element 30 can, if it is useful, be switched to its closed position.

With the obturator element 30 in a closed position, the ventilation passage 22 is at least partially, preferably fully, obturated and the exchange of air between the shaft 14 and the atmosphere is reduced or even prevented. This leads to less heat loss and thus to a saving of energy within the building 10.

The usefulness of switching the obturator element 30 in a closed position can be evaluated by the control unit 32 based on several sensors. Amongst these sensors, we can list, non-exhaustively, the following:

- temperature sensors 46, 46', 46", 46''' on the different levels 12, 12', 12", 12''' inside the building 10,
- a temperature sensor 48 outside the building 10,
- a solar radiation sensor 50 outside the building 10,
- a wind speed sensor 52 outside the building 10, and
- third presence detectors 54, 54', 54", 54''' on the different levels 12, 12', 12", 12''' inside the building 10.

To further improve the safety of the energy management system, the control unit 32 can optionally comprise two redundant central processing units 32, 32'. The control unit 32 and the central processing units respectively can be fitted with emergency batteries to ensure proper operation of the system in the event of a power cut.

A bidirectional communication system, for example digital or frequency-based, is provided between the control unit 32 and the obturator element 30, thereby allowing the obturator element 30 to be controlled and information feedback on the position of the obturator element 30 to be collected. The control unit is therefore capable of transmitting an indication of the position of the obturator element 30 to an information unit 56. Visual or acoustic indicators can be used to indicate the state of opening of the ventilation passage 22 and the operating state of the system.

The control unit 32 can be of modular type, flexibly accommodating several types of interface with the peripheral hardware of a complex surrounding system, or of fixed type, restricting itself to a limited number of peripheral hardware elements.

The control unit 32 can be equipped with any interface, based on any available support, such as BUS or EIB technology for example, so that it can be incorporated into the control and technical management of large buildings. The control unit 32 can be equipped with a central processing unit under EPROM or any other pre-programmed support, as well as a random access memory, which is freely programmable according to the needs and obligations of the client. The control unit 32 can have standardized or programmable interfaces for possible direct connection to the lift processing unit informing about the lift status. The different components, such as sensors, the obturator element and detectors, can be connected to the control unit 32 by means of electric cables of all types, radio waves, optical fibres, wireless, LED, infrared, induction fields or any other communication means.

It should be noted that a lifting installation can generally also comprise a machine room. In this case, ventilation of the shaft can be undertaken through a ventilation passage linked to the machine room, which itself is linked to the shaft. Within the scope of the present application, such a machine room is considered to form an integral part of the shaft. Thus, for example, the presence of a person in the machine room is equivalent to presence of a person in the shaft and ventilation of the shaft can be ensured by its ventilation passage, even if the machine room is placed between the shaft and the ventilation passage towards the atmosphere.

Except for the fact that the present thermal energy management method and system contribute to energy-saving in new and existing buildings, they are particularly suitable for installation of a lift in a low-energy or passive building.

The invention claimed is:

1. A thermal energy management method in a building comprising a lifting installation with a mobile car in a shaft and a ventilation passage between said shaft and the atmosphere, said method comprising the following steps:

monitoring of at least one state parameter of said lifting installation; said monitoring of at least one state parameter comprising monitoring of a presence of a person in said lifting installation and/or monitoring of a movement of said car in said shaft;

evaluation, in a control unit, of the necessity to ventilate said shaft based on said state parameter, said control unit concluding to the necessity to ventilate said shaft if one of a presence of a person and/ when a movement of said car is detected;

switching of an obturator element associated with said ventilation passage from an open position, wherein said ventilation passage is essentially open, to a closed position, wherein said ventilation passage is substantially obturated, only when said evaluation indicates that ventilation of said shaft is not required, said obturator element being prestressed to its open position.

2. The method according to claim 1, wherein monitoring of a presence of a person in said lifting installation comprises monitoring of a presence of a person in said car, on the roof of said car or in said shaft.

3. The method according to claim 1, wherein said control unit concludes to a non-necessity to ventilate said shaft, when:

no presence of a person in said car, on the roof of the car or in said shaft is detected; and no movement of said car is detected.

4. The method according to claim 1, further comprising the following steps:

monitoring of at least one control parameter;

evaluation of the usefulness of obturating said ventilation passage based on said at least one control parameter;

switching of said obturator element in its closed position when said control unit concludes to a non-necessity to ventilate said shaft, and when said evaluation indicates that obturation of said ventilation passage is useful.

5. The method according to claim 4, wherein monitoring of at least one control parameter comprises monitoring of at least one parameter chosen from the group comprising:

the temperature inside said building;

the temperature inside said shaft;

the presence of a person on a landing of a level of said building;

the temperature outside said building;

the wind speed outside said building; and the level of solar radiation outside said building.

6. The method according to claim 1, further comprising the memorization, in a storage unit, of said state parameters and of a position of said obturator element.

7. The method according to claim 1, further comprising the memorization, in a storage unit, of said control parameters and of a position of said obturator element.

8. The method according to claim 1, further comprising communication of information on a position of said obturator element and/or on an operating state of said control unit.

9. A thermal energy management system in a building comprising a lifting installation with a mobile car in a shaft and a ventilation passage between said shaft and the atmosphere, said system further comprising:

an obturator element associated with said ventilation passage, said obturator element being mobile between an open position, wherein said ventilation passage is essentially open, and a closed position, wherein said ventilation passage is substantially obturated;

a prestressing means for maintaining, in a passive state, said obturator element in its open position; and a control unit for controlling a position of said obturator element, said control unit comprising means for monitoring at least one state parameter of said lifting installation and for evaluating a necessity to ventilate said shaft, said control unit only allowing switching of said obturator element to a closed position when the evaluation of a necessity to ventilate said shaft indicates that ventilation of said shaft is not required, said means for monitoring at least one state parameter of said lifting installation comprising one of at least one means for detecting a presence of a person in said lifting installation and/ at least one means for detecting a movement of said car in said shaft, said control unit concluding to a necessity to ventilate said shaft when one of a presence of a person and/ when a movement of said car is detected.

10. The system according to claim 9, wherein said means for detecting a presence of a person in said lifting installation comprises at least one presence sensor in said car, on the roof of said car or in said shaft.

11. The system according to claim 9, wherein said means for detecting a movement of said car in said shaft comprises at least one movement sensor.

12. The system according to claim 9, further comprising at least one control parameter sensor, said control unit comprising means for evaluating a usefulness of obturating said ventilation passage based on said at least one control parameter.

13. The system according to claim 12, wherein said at least one control parameter sensor is chosen from the group comprising:

a temperature sensor inside said building;

a temperature sensor inside said shaft;

a presence sensor for a person on a landing of a level of said building;

a temperature sensor outside said building;

a wind speed sensor outside said building; and a solar radiation level sensor outside said building.

14. The system according to claim 9, wherein said control unit comprises at least two redundant central processing units.

15. The system according to claim 9, further comprising a storage unit, said storage unit memorizing said state parameters and a position of said obturator element.

16. The system according to claim 12, further comprising a storage unit, said storage unit memorizing said control parameters and a position of said obturator element.

17. The system according to claim 9, further comprising an information unit signalling a position of said obturator element and/or an operating state of said control unit.

* * * * *